US006578394B2

(12) United States Patent
Yin

(10) Patent No.: US 6,578,394 B2
(45) Date of Patent: Jun. 17, 2003

(54) PORTABLE COMPUTER SECURITY DEVICE

(75) Inventor: Memphis Zhihong Yin, Corvallis, OR (US)

(73) Assignee: Hewlett-Packard Development Company, Houston, TX (US)

( * ) Notice: Subject to any disclaimer, the term of this patent is extended or adjusted under 35 U.S.C. 154(b) by 0 days.

(21) Appl. No.: 09/947,679

(22) Filed: Sep. 6, 2001

(65) Prior Publication Data

US 2003/0041631 A1 Mar. 6, 2003

(51) Int. Cl.[7] ..... E05B 73/00

(52) U.S. Cl. ..... 70/58; 70/14; 70/18; 70/49; 248/551; 248/685

(58) Field of Search ..... 70/18, 58, 30, 70/49, 53, 14; 248/551, 685, 686; 401/99

(56) References Cited

U.S. PATENT DOCUMENTS 1,475,256 A * 11/1923 Belair ..... 70/18
2,190,661 A * 2/1940 Hauer ..... 70/49
4,096,715 A * 6/1978 Lipschutz ..... 70/59
4,212,175 A 7/1980 Zakow
4,881,386 A * 11/1989 Glines ..... 70/19
4,884,730 A * 12/1989 Carpenter ..... 224/162
4,970,882 A * 11/1990 Arrendondo ..... 70/30
4,979,382 A * 12/1990 Perry ..... 70/58
5,251,464 A * 10/1993 Halter ..... 70/30
5,327,752 A 7/1994 Myers et al.
5,351,507 A 10/1994 Derman
5,381,685 A 1/1995 Carl et al.
5,493,878 A 2/1996 Murray, Jr. et al.
5,502,989 A 4/1996 Murray, Jr. et al.
5,673,573 A * 10/1997 Green ..... 70/14
5,709,110 A * 1/1998 Greenfield et al. ..... 70/58
5,787,738 A 8/1998 Brandt et al.
5,791,170 A * 8/1998 Officer ..... 70/49
6,000,251 A 12/1999 Murray, Jr. et al.
6,000,252 A 12/1999 Murray, Jr. et al.
6,112,562 A 9/2000 Murray, Jr. et al.
6,155,088 A 12/2000 Murray, Jr. et al.
6,170,304 B1 1/2001 Ohta
6,177,869 B1 1/2001 McDaid
6,196,857 B1 3/2001 Fong
6,199,413 B1 3/2001 McDaid et al.
6,212,918 B1 4/2001 Kravtin
6,216,499 B1 4/2001 Ronberg et al.
6,244,080 B1 6/2001 Sakurai
6,244,082 B1 6/2001 Avganim
6,257,029 B1 * 7/2001 Liao ..... 70/58

* cited by examiner

*Primary Examiner*—Anthony Knight
*Assistant Examiner*—Christopher Boswell

(57) ABSTRACT

A security device for portable computer is disclosed. The security device comprises an anchor attached securely to the portable computer. The device also includes a lock box that makes use of a channel, wherein the channel is open at each end and is selectively openable laterally. The device further includes a cord that couples the anchor and the lock box.

17 Claims, 4 Drawing Sheets

PORTABLE COMPUTER SECURITY DEVICE

BACKGROUND OF THE INVENTION

The present invention relates generally to locking and security devices, and particularly to a locking and security device for preventing theft of portable computers.

Portable computers by their nature are used in a variety of locations. Most typically, a portable computer user sets up a temporary work site and makes use of the portable computer. For example, the user may sit in a library or cafe at a table and chair and set up a portable computer. Unfortunately, the user often finds need to move from the temporary work site for brief times. For example, to visit a restroom, purchase a beverage, or retrieve reference items in a library. Given the portable and compact nature of such valuable computing devices, leaving such a device unattended for even the briefest time presents significant risk of theft. Nevertheless, some portable computer users will risk such theft due to the inconvenience of carrying with them at all times their portable computing device.

Once the portable computing device is set up at a selected temporary work site, some portable computer users tend to leave the portable computer in place even while leaving the work site for brief times. Other users may take the time and trouble to break down their temporary work site and carry with them their portable computing device to avoid any risk of theft. Preferably, however, portable computer users have a mechanism for securing their portable computing device against theft even while unattended at a temporary work site. Accordingly, a variety of devices have evolved with the general purpose of protecting against or impeding theft while unattended at a temporary work site.

A common security device for portable computers is known as a Kensington lock. Generally, the Kensington lock is a cable having at one end a preformed small loop formation and at the other end a lug attachable to a preformed mounting site on the portable computer. In use, the cable attaches to an object by passing the lug portion around the object and through the small preformed loop at the distal end of the cable. This forms a loop about the object and leaves the lug element available for attachment to the computer. The preformed mounting site on the computer lockably receives the lug and thereby secures the portable computer to the larger object. The preformed loop provided at the distal end of the cable need only be large enough to allow passage of the lug therethrough. The relatively larger loop formation created at the distal end of the cable, i.e., a length portion of the cable adjacent the preformed loop and passing through the preformed loop, remains coupled to the object so long as the lug remains attached to the portable computer and so long as the preformed loop is smaller than the computer itself.

It would be preferable, however, to provide a portable computer security device more conveniently carried with the portable computing device and used to prevent or impede theft thereof.

SUMMARY OF THE INVENTION

A security device under the present invention as applied to a portable computer includes an anchor attached securely to the portable computer. A lockbox includes an open ended channel having a lateral or side wall selectively openable and lockably closed. A cord couples the anchor and the lock box. The cord attaches to an immobile or relatively immobile object by passing the lock box around the object and opening the channel to laterally receive and capture the cord therein. This creates a selectively lockable loop formation about the object and secures the portable computer to the object.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
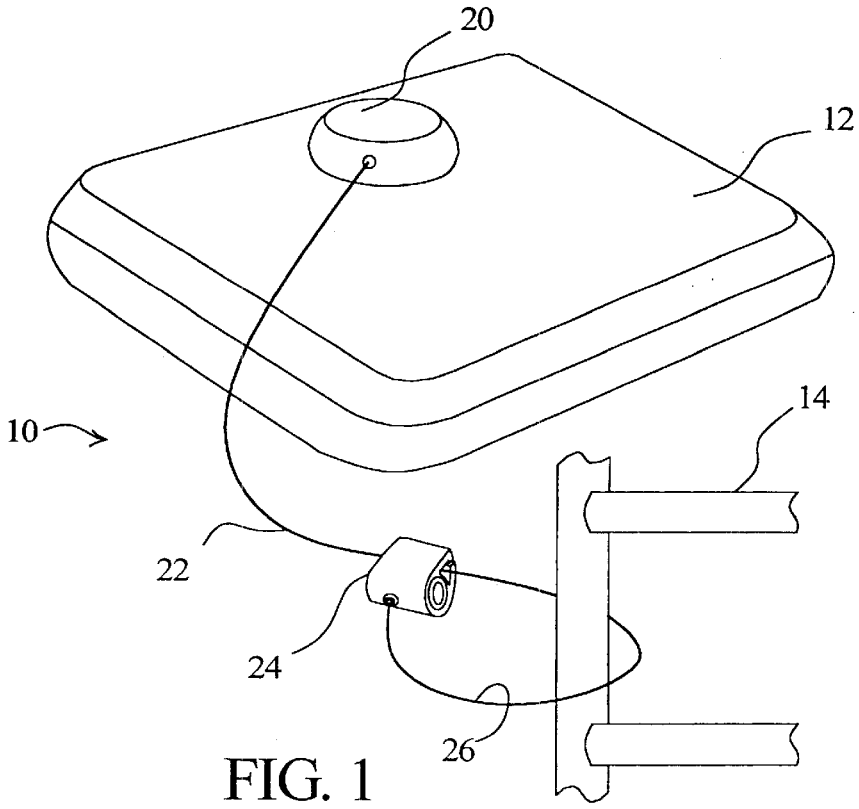
FIG. 1 illustrates a first embodiment of the present invention, a portable computer security device coupling in secure fashion a portable computer to, for example, a chair.

FIG. 1 illustrates the use of a portable computer security device 10 according to the first embodiment of present invention as applied to a notebook computer 12 to secure notebook computer 12 relative to an object, e.g., chair 14. Security device 10 includes an anchor 20 securely attached to computer 12, a cord 22 extending therefrom, and a loop-forming lock box 24 at a distal end of cord 22. As discussed more fully hereafter, loop-forming lock box 24 creates a loop structure 26 at the distal end of cord 22. By forming loop structure 26 about a relatively larger object, e.g., chair 14, security device 10 prevents, or at least hinders, the unauthorized taking of computer 12 without also taking chair 14. As may be appreciated, loop structure 26 may be coupled to a variety of objects, such as chair 14, including relatively immobile objects, e.g., a table leg, building post, building pillar, or other such structures which may be captured within loop structure 26 according to an embodiment of the present invention.

As used herein, reference to chair 14, or other relatively immobile object, refers to a structure selected by the user for attaching to the portable computer by way of the security device that accords with the present invention. Thus, chair 14, or other selected object may be in fact immovable or merely a relatively larger object that significantly impedes the theft of a portable computer attached thereto.

Anchor 20 securely attaches to the body of computer 12 according to a variety of methods and structures. For example, anchor 20 can be coupled to computer 12 by way of a sufficiently durable and strong adhesive. In such configuration, security device 10 may be coupled, i.e., retrofit, to any portable computing device. Alternatively, anchor 20 may be mechanically and selectively lockably coupled to a preformed structure on a given portable computer 12. In such case, anchor 20 selectively detaches from the portable computer 12, but securely attaches when security device 10 is in use. Finally, anchor 20 may be integrally formed at a time during the manufacture of portable computer 12, thus being permanently integrated therewith. In any case, anchor 20 should be sufficiently secured to computer 12 to avoid detachment therefrom. In a preferred form of the present invention, anchor 20 permanently attaches to the device to be secured, e.g., to computer 12.

Figure 2:
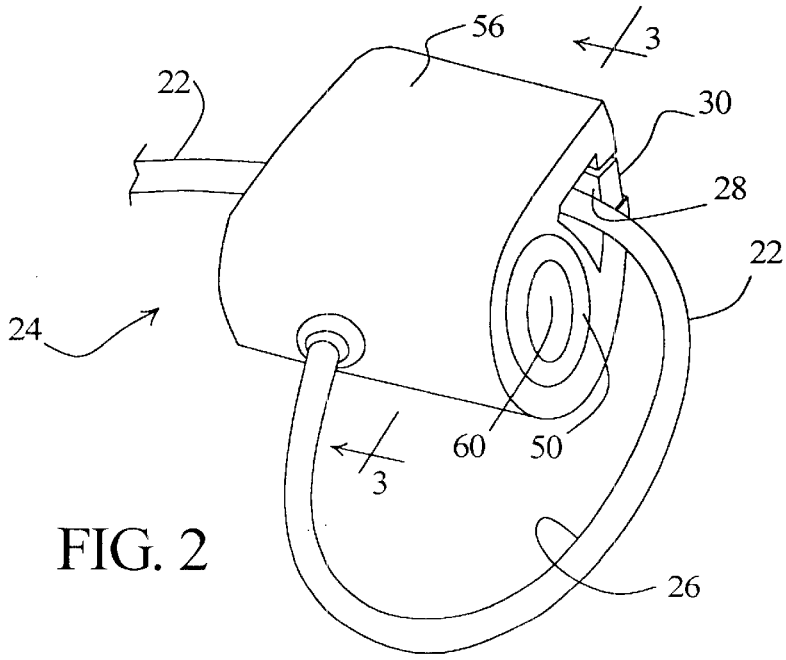
FIG. 2 illustrates a lock box of the security device of FIG. 1 and loop structure formed thereby.

FIG. 2 illustrates in more detail the distal end of cord 22 including loop structure 26 as established by use of lock box 24. As illustrated in FIG. 2 lock box 24 is shown in its locked condition including cord channel 28 in which a length portion of cord 22 resides. As described more fully hereafter, lock box 24 includes, along a lateral wall of channel 28, a tongue 30. Tongue 30 laterally opens channel 28 when lock box 24 is opened, i.e., taken out of its locked condition. Thus, loop structure 26 forms by opening channel 28, i.e., moving tongue 30 out of its closed position, thereafter positioning a length portion of cord 22 within channel 28. Once cord 22 is so positioned, tongue 30 moves into its closed position to capture cord 22 within channel 28. As may be appreciated, cord 22 cannot be moved laterally from channel 28 when in its locked position, but does enjoy longitudinal freedom of movement along channel 28. Thus, loop structure 26 assumes a variety of sizes by sliding cord 22 within channel 28. Thus, loop formation 26 suitably surrounds objects, such as chair 14, which may be of varying size.

To capture an object 14 within a loop structure 26, one begins with cord 22 outside channel 28. Lock box 24 moves about an object and comes into position adjacent a length portion of cord 22. Channel 28 opens, i.e., tongue 30 moves to its open position, to allow a length portion of cord 22 to enter laterally into channel 28. Once cord 22 is positioned within channel 28, lock box 24 locks, i.e., tongue 30 moves to its closed position, to capture cord 22 within channel 28 and to also capture an object, e.g., chair 14, within the loop structure 26 created by lock box 24 and cord 22.

Figure 3:
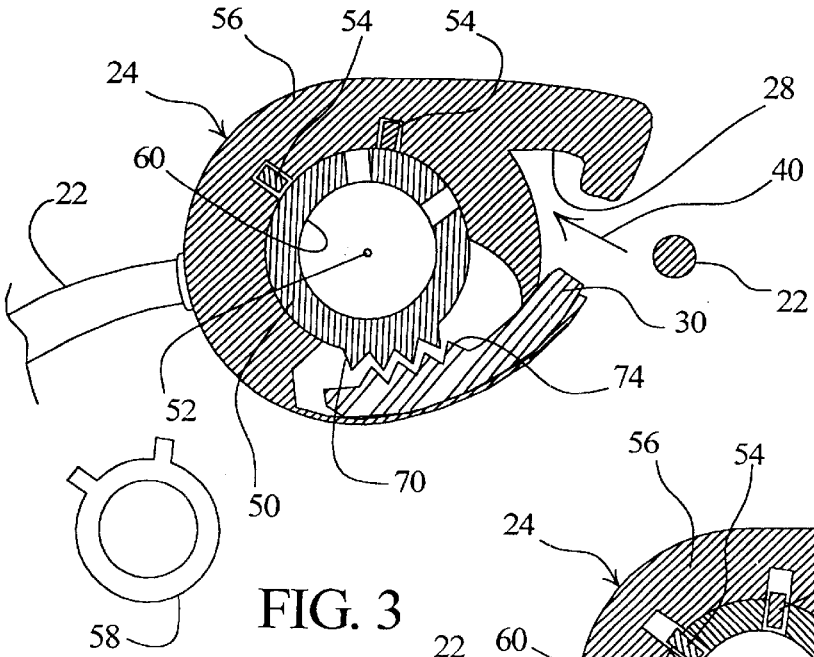
FIG. 3 illustrates the lock box of FIG. 2 as taken along lines 3—3 of FIG. 2 and showing the lock box of FIG. 2 in its open or unlocked condition.
Figure 4:
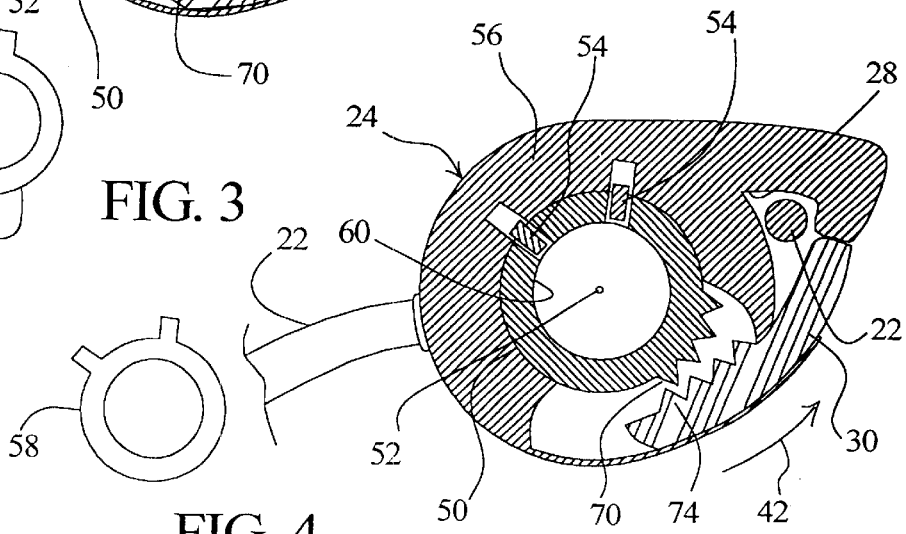
FIG. 4 illustrates the lock box of FIG. 2 as taken along lines 3—3 of FIG. 2 but illustrating the lock box in its closed or locked condition.

FIGS. 3 and 4 illustrate schematically lock box 24 in its unlocked or open state (FIG. 3) and in its locked or closed state (FIG. 4). In FIG. 3, lock box 24 is shown in its open condition with channel 28 opened laterally by displacement of tongue 30. FIG. 4 illustrates lock box 24 in its closed condition with channel 28 laterally closed by suitable placement of tongue 30. In FIG. 3, with channel 28 laterally open, cord 22 moves laterally, as indicated at reference numeral 40, into channel 28. Once so positioned, i.e., as in FIG. 4, tongue 30 moves, as indicated at reference numeral 42, to its closed position thereby laterally capturing cord 22 within channel 28.

The particular lock mechanism used to permit lateral entry of cord 22 into channel 28 and thereafter to laterally close channel 28 may be according to a variety of structural and mechanical arrangements. In the particular arrangement of lock box 24, i.e., according to this particular illustrated embodiment of the present invention, lock box 24 includes an inner tube 50 rotatable, under certain allowed conditions, about a central axis 52 of lock box 24. A set of lock pins 54 couple inner tube 50 and lock box case 56 to prevent rotation of inner tube 50 about axis 52. A key (58) suitably positioned within a central key aperture 60 moves pins 54 out of engagement relative to inner tube 50. Thus, insertion of key 58 into aperture 60 permits rotation of inner tube 50 about central axis 52.

It will be understood, however, that a particular locking mechanism selected for use in conjunction with the present invention may assume a variety of forms according to known locking structures and methods. The schematic illustration shown herein presents a simplified form of one candidate locking mechanism considered suitable under the present invention. Generally, lock box 24 desirably possesses a capability of laterally and lockably capturing cord 22 within an otherwise open ended channel 28. This allows lock box 24, when situated at the distal end of cord 22, to approach a length portion of cord 22 laterally and lockably capture that length portion of cord 22 within its channel and thereafter block lateral escape.

An outward facing surface of inner tube 50 carries a gear set 70. Thus, rotation of inner tube 50 moves gear set 70 relative to the remainder of lock box 24, i.e., relative to case 56. Tongue 30 is captured between inner tube 50 at gear set 70 and inner surface 72 of case 56. Tongue 30 carries gear set 74, which is matingly compatible and engaged relative to gear set 70. Thus, rotational movement of inner tube 50 translates into thrusting movement of tongue 30 between its open (FIG. 3) and its closed positions (FIG. 4) as indicated by reference numeral 42. In other words, rotation of inner tube 50 moves gear set 70 along a path coincident with the allowed path of tongue 30 and, by virtue of mutual engagement between gear set 70 and gear set 74, tongue 30 moves reciprocally between its open and closed positions by reciprocal rotational movement of inner tube 50. Because inner tube 50 moves only by use of a suitable key 58, lock box 24 cannot be changed from its closed to open position without the use of a suitable instrument, such as key 58. A particular embodiment of the present invention, however, need not necessarily prevent movement of tongue 30 from the closed to open position absent use of key 58. A preferable security feature is, as may be appreciated, the prevention of movement of tongue 30 from a closed to an open position without use of an appropriate device, such as key 58.

Figure 5:
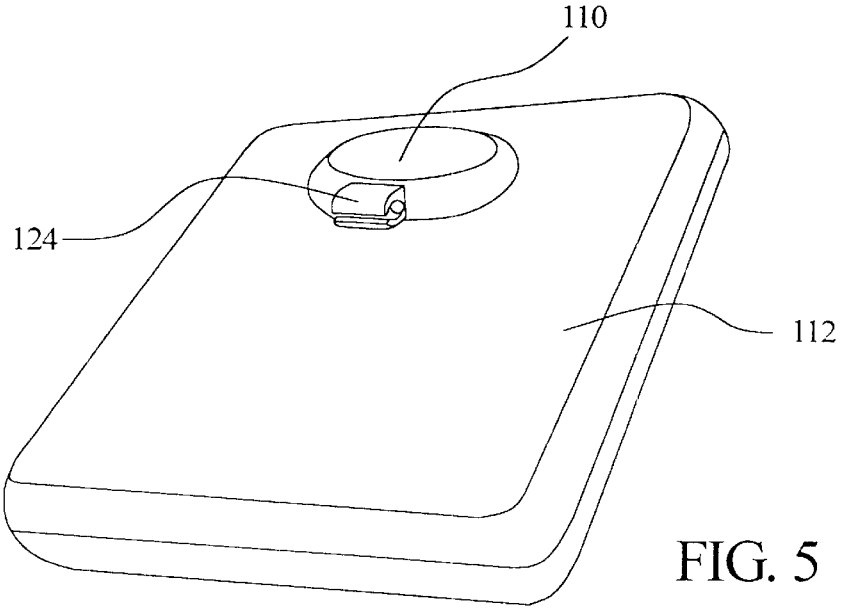
FIG. 5 illustrates a second embodiment of the present invention including a retractable form of portable computer security device.

FIG. 5 illustrates a second embodiment of the present invention. In FIG. 5, security device 110 including retractable lock box 124 are shown. As illustrated in FIG. 5, lock box 124 is in its fully retracted position with its cord 122 (shown in FIG. 6) collected within the body of anchor 120. Anchor 120 securely attaches to the body of a device to be secured, e.g., portable computer 112. When not in use, cord 122 withdraws for storage within anchor 120 and lock box 124 resides adjacent anchor 120.

Anchor 120 securely can attach to the body of computer 112 according to a variety of methods and structures. For example, anchor 120 can be coupled to computer 112 by use of sufficiently durable and strong adhesive. In such configuration, security device 10 may be coupled, i.e., retrofit, to any portable computing device. Alternatively, anchor 120 may be mechanically and selectively lockably coupled to a preformed structure on a given portable computer 112. In such case, anchor 120 selectively detaches from the portable computer 112, but securely attaches when security device 10 is in use. Finally, anchor 120 may be integrally formed at the time of portable computer 10 manufacture and thereby permanently integrated therewith. In any case, during use of portable computer 112, anchor 120 should be sufficiently secured to the computer to avoid detachment therefrom. In a preferred form of the present invention, anchor 120 permanently attaches to the device it secures, e.g., permanently attaches to computer 112.

Figure 6:
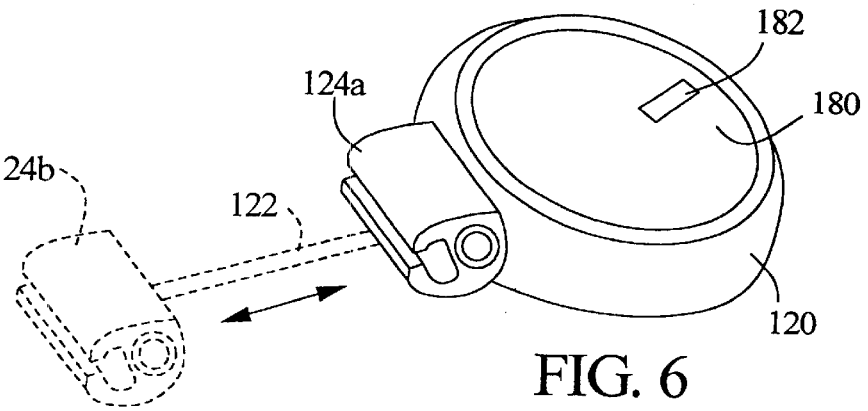
FIG. 6 illustrates operation of the retractable security device of FIG. 5 including a variable length cord extending between a lock box and anchor thereof.

FIG. 6 illustrates anchor 120 apart from computer 112 and illustrates lock box 124 in its fully retracted position, as indicated at referenced numeral 124a and similar to that shown in FIG. 5. FIG. 6 also illustrates lock box 124 in its extended position, as indicated at reference numeral 124*b* in FIG. 6. Cord 122 extends from the body of anchor 120 as attached to lock box 124 and collects about spool 180 (FIG. 9) within the body of anchor 120. A hinged or pop up crank knob 182 operates to rotate spool 180 to collect, i.e., wind up, cord 122 on spool 180.

Figure 7:
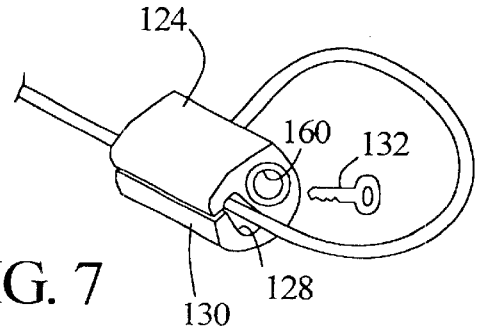
FIG. 7 illustrates in more detail the loop structure feature of the lock box of FIG. 5

FIG. 7 illustrates a loop formation using lock box 124 and cord 122. Generally, lock box 124 is identical to lock box 24 and includes an open ended cord channel 128 and tongue 130. Key 132 engages key aperture 160 of lock box 124 to selectively move tongue 130 into and out of an open and closed position. More particularly, key 132 operates to open laterally channel 128 and allow cord 122 to move laterally into channel 128. Once cord 122 is so positioned, key 132 operates to close laterally channel 128, i.e., move tongue 130 into its closed position, and prevent lateral escape of cord 122 from channel 128.

Figure 8:
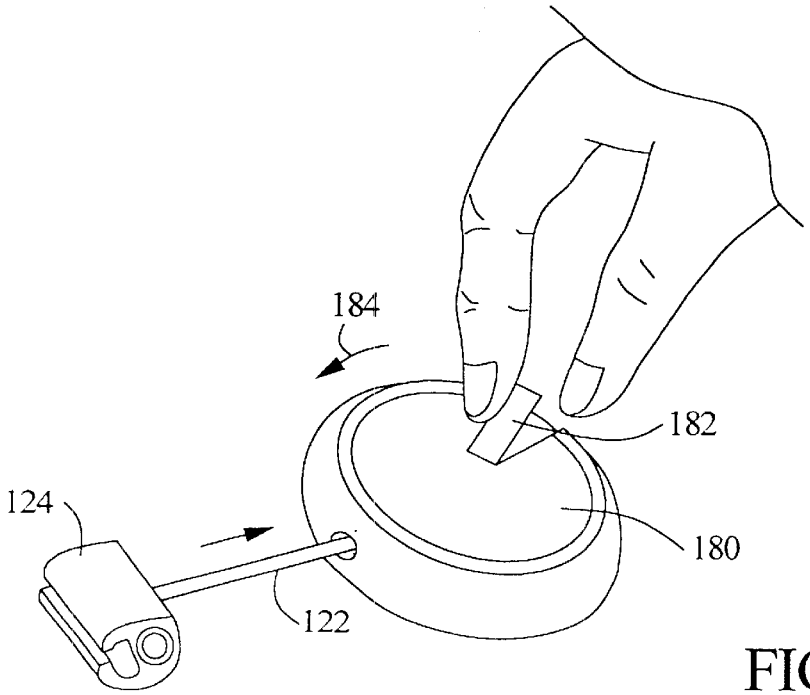
FIG. 8 illustrates retraction of a cord portion of the security device of FIG. 5.

As may be appreciated, lock box 124 may be extended from anchor 120 to a selected distance by merely pulling lock box 124 away from anchor 120 and thereby unspooling or unwinding cord 122 from spool 180. Spool 180 may be rotated manually to collect, i.e., wind, cord 122 on spool 180 as illustrated in FIG. 8 by grasping knob 182 and rotating spool 180 as indicated at reference numeral 184 in FIG. 8.

Figure 9:
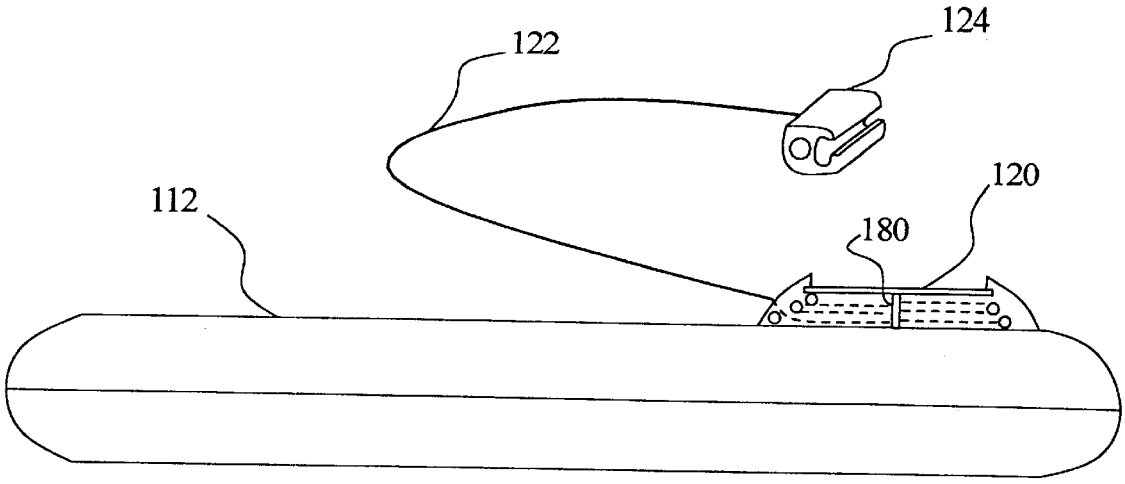
FIG. 9 illustrates the retractable security device of FIG. 5 prior to forming a loop structure and as anchored to a portable computer.
Figure 10:
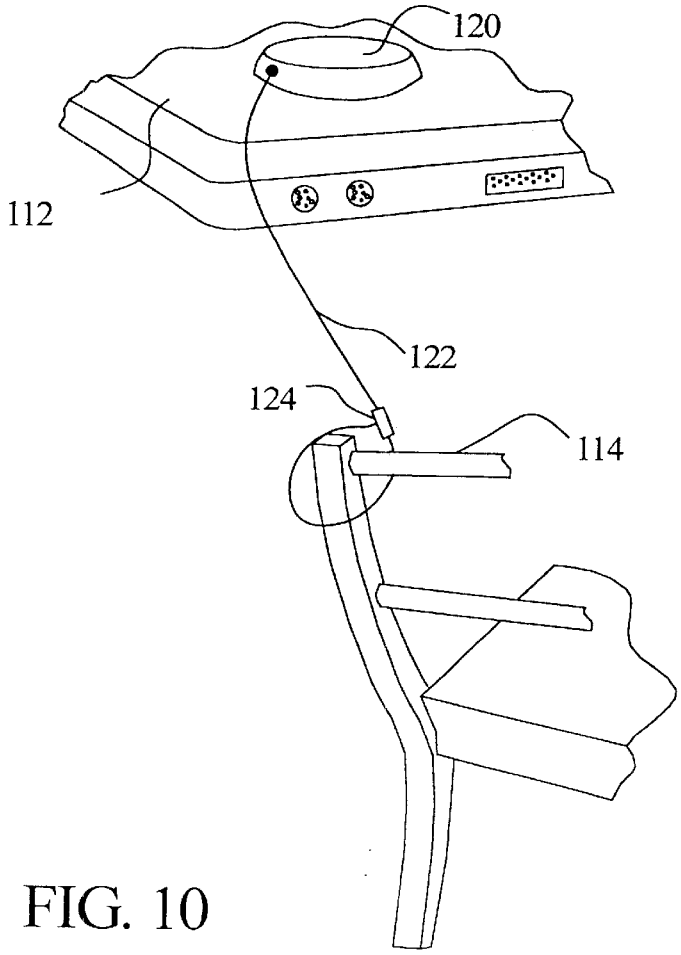
FIG. 10 illustrates the retractable security device of FIG. 5 as coupled to a relatively larger object.

Thus, lock box 124 extends a selected distance from anchor 120 as indicated in FIG. 9. Lock box 124 resides at the distal end of cord 122 and cord 122, as extended from anchor 120, may be at a selected distance therefrom. To secure computer 112 relative to an object 114 (of FIG. 10), one passes lock box 124 around the relatively larger object and opens channel 128 to laterally receive a length portion of cord 122 within channel 128. Thereafter, key 132 operates to close laterally channel 128 and thereby laterally and lockably capture cord 122 within channel 128. FIG. 10 illustrates attachment of computer 112 by way of anchor 120, cord 122, and lock box 124 to a chair 114.

While illustrated as being coupled to a chair 114, it will be understood that the present invention allows a user to couple a portable computing device to a variety of immovable and relatively immovable objects such as chair 14. Preferably, a valuable portable computer is attached to a relatively larger object and thereby requires that a thief also carry away the relatively immobile object in addition to the computer. Thus, a thief would be discouraged from theft due to the inability to conceal the relatively larger object. In other words, while it may be possible to grab and hide a portable computer by itself, one cannot nearly as easily grab and conceal a relatively larger object, e.g., chair 114, and expect to be successful in walking away unnoticed.

While not specifically detailed herein, it will be understood that cords 22 and 122 are of suitable material for the purposes shown herein. More particularly, cords 22 and 122 should be flexible enough to allow loop formation, i.e., loops 26 and 126. Furthermore, cords 22 and 122 should be of suitable material to make impossible or significantly impede any cutting thereof. Thus, cords 22 and 122 can be of steel cable, sheathed steel cable, sufficiently durable and tamper-resistant plastic material, or other such materials as are appropriate for the given purpose of preventing or substantially impeding theft of a portable device. In other words, the degree of security desired dictates the selection of materials for cords 22 and 122. For greater security, more durable and tamper-resistant material should be selected for use in cords 22 and 122.

It will be appreciated that the present invention is not restricted to the particular embodiment that has been described and illustrated, and that variations may be made therein without departing from the scope of the invention as found in the appended claims and equivalents thereof.

What is claimed is:

1. A security device for portable computer, the security device comprising:

an anchor attached securely to said portable computer;

a lock box including a channel, said channel being open at each end thereof and selectively openable laterally; and a cord coupling said anchor and said lock box.

2. A security device for portable computer according to claim 1 wherein said cord as coupled to said anchor is a retractable cord relative to said anchor.

3. A security device for portable computer according to claim 1 wherein said lock box comprises a central tube selectively rotatable when in an unlocked condition; and a tongue coupled to said tube and comprising a side wall of said channel, said tongue moving in response to rotation of said central tube.

4. A security device for portable computer according to claim 3 further comprising a key operable to place said lock box selectively in one of said unlocked condition and a locked condition, said locked condition preventing rotation of said central tube.

5. A security device for portable computer according to claim 1 further comprising a key operable to place said lock box selectively in one of a locked condition and an unlocked condition, said locked condition including said channel being closed laterally.

6. A security device for portable computer according to claim 1 wherein said anchor is integrally formed with and thereby permanently attached to said portable computer.

7. A security device for a portable computer, the security device comprising:

an anchor attached to said portable computer;

a lock box including a channel, said channel including open ends, said channel being selectively placed in one of a locked condition and an unlocked condition, said locked condition including said channel being laterally closed, said unlocked condition including said channel being laterally open;

a cord coupling said anchor and said lock box; and a key cooperative with said lock box to place said lock box selectively in one of said unlocked condition and said locked condition.

8. A security device for portable computer according to claim 7 wherein said cord as coupled to said anchor is a retractable cord relative to said anchor.

9. A security device for portable computer according to claim 7 wherein said lock box comprises a central tube selectively rotatable when in said unlocked condition; and a tongue coupled to said tube and comprising a side wall of said channel, said tongue moving in response to rotation of said central tube.

10. A security device for portable computer according to claim 9 further comprising a key operable to place said lock box selectively in one of said unlocked condition and said locked condition, said locked condition preventing rotation of said central tube.

11. A security device for portable computer according to claim 7 further comprising a key operable to place said lock box selectively in one of said locked condition and said unlocked condition, said locked condition including said cord within said channel.

12. A security device for portable computer according to claim 7 wherein said anchor is integrally formed with and thereby permanently attached to said portable computer.

13. A security device for portable computer according to claim 7 wherein said locked condition of said lock box captures said cord within said channel.

14. A method of securing a portable computer device, said method comprising:

securing an anchor to said portable computer device;

securing a first end of a cord to said anchor;

securing a lock box to a second end of said cord, said lock box including an open ended channel, said open ended channel including a wall portion selectively movable between a locked position and an unlocked position, said locked position laterally closing said channel, said unlocked condition laterally opening said channel; and passing said lock box around an object and positioning said lock box adjacent a length portion of said cord with said lock box in its unlocked condition to place said length portion of said cord within said channel and thereafter capturing said length portion of said cord within said channel by moving said lock box to its locked condition.

15. A method according to claim 14 wherein said securing an anchor step comprises securing said anchor permanently to said portable computer device.

16. A method according to claim 14 wherein said securing a first end of a cord step comprises securing said first end of said cord to said anchor in a retractable relationship therebetween.

17. A method according to claim 14 wherein said method further comprises placing said lockbox selectively in at least one of said locked position and said unlocked position by inserting a key into said lock box.

* * * * *